US006988067B2

(12) United States Patent
Kim et al.

(10) Patent No.: US 6,988,067 B2
(45) Date of Patent: Jan. 17, 2006

(54) LSF QUANTIZER FOR WIDEBAND SPEECH CODER

(75) Inventors: Dae-Sik Kim, Daejeon (KR); Song-In Choi, Daejeon (KR); Byung-Sik Yoon, Daejeon (KR); Hyung-Jung Kim, Daejeon (KR); Sang-Won Kang, Anyang (KR); Sang-Hyun Chi, Kangwon-do (KR)

(73) Assignee: Electronics and Telecommunications Research Institute (KR)

( * ) Notice: Subject to any disclaimer, the term of this patent is extended or adjusted under 35 U.S.C. 154(b) by 723 days.

(21) Appl. No.: 10/033,649

(22) Filed: Dec. 27, 2001

(65) Prior Publication Data

US 2002/0138260 A1 Sep. 26, 2002

(30) Foreign Application Priority Data

Mar. 26, 2001 (KR) ..... 2001-15675

(51) Int. Cl.
*G10L 19/04* (2006.01)
*G10L 19/14* (2006.01)

(52) U.S. Cl. ..... 704/222; 704/230

(58) Field of Classification Search ..... 704/205, 704/206, 219, 220, 221, 222, 223, 230
See application file for complete search history.

(56) References Cited

U.S. PATENT DOCUMENTS 5,271,089 A * 12/1993 Ozawa ..... 704/222
5,675,701 A * 10/1997 Kleijn et al. ..... 704/222
5,774,839 A 6/1998 Shlomot
5,822,723 A 10/1998 Kim et al.
5,826,225 A * 10/1998 Hartung et al. ..... 704/222
6,006,179 A * 12/1999 Wu et al. ..... 704/222
6,504,877 B1 * 1/2003 Lee ..... 375/265
6,516,297 B1 * 2/2003 Servetto et al. ..... 704/222
6,622,120 B1 * 9/2003 Yoon et al. ..... 704/222
6,820,052 B2 * 11/2004 Das et al. ..... 704/208

OTHER PUBLICATIONS

Jianping Pan, "Two–stage vector quantization–pyramidal lattice vector quantization and application to speech LSP coding," 1996 International Conference on Acoustics, Speech, and Signal Processing, 1996, May 7–10, 1996, vol. 2, pp. 737 to 740.*

Wang et al., "Pyramid transform coding using vector quantization," 1988 International Conference on Acoustics, Speech, and Signal Processing, 1988, Apr. 11–14, 1988, vol. 2, pp. 812 to 815.*

Erdmann et al., "Embedded speech coding based on pyramid CELP," Speech Coding, 2002, IEEE Workshop Proceedings, Oct. 6–9 2002, pp. 29 to 31.*

Collura et al., "Vector quantizer design for the coding of LSF parameters," 1993 IEEE International Conference on Acoustics, Speech, and Signal Processing, Apr. 27–30, 1993, vol. 2, pp. 29 to 32.*

* cited by examiner

*Primary Examiner*—Martin Lerner
(74) *Attorney, Agent, or Firm*—Blakely Sokoloff Taylor & Zafman

(57) ABSTRACT

The LSF quantizer for a wideband speech coder comprises a subtracter for receiving an input LSF coefficient vector and removing a DC component from it; a memory-based vector quantizer and a memoryless vector quantizer for respectively receiving the DC-component-removed LSF coefficient vector and independently quantizing the same; a switch for receiving quantized vectors respectively quantized by the memory-based vector quantizer and the memoryless vector quantizer, selecting a quantized vector that has less quantized error that is a difference between the received quantized vector and the input LSF coefficent vector from among the received quantized vectors, and outputting the same; and an adder for adding the quantized vector selected by the switch to the DC component of the LSF coefficient vector.

7 Claims, 1 Drawing Sheet

LSF QUANTIZER FOR WIDEBAND SPEECH CODER

BACKGROUND OF THE INVENTION

1. Field of the Invention

The present invention relates to a line spectral frequency (LSF) quantizer for a wideband speech coder. More specifically, the present invention relates to an LSF quantizer for a wideband speech coder that employs predictive pyramid vector quantization (PPVQ) and pyramid vector quantization (PVQ) usable for LSF quantization with a wideband speech quantizer.

2. Description of the Related Art

In general, it is of great importance to efficiently quantize an LSF coefficient indicating a correlation between short intervals of a speech signal for the sake of high-quality speech coding with a speech coder. The optimum linear predictive coefficient of a linear predictive coefficient (LPC) filter is calculated in a manner such that an input speech signal is divided by frames to minimize the energy of prediction errors by frame. The LPC filter of an AMR_WB (Adaptive Multi-Rate_Wideband) speech coder standardized as a wideband speech coder for a 3GPP IMT-2000 system by Nokia is a $16^{th}$-order all-pole filter that requires a certain number of bits to be allocated for quantization of the 16 linear predictive coefficients.

As an example, IS-96A QCELP (Qualcomm Code Excited Linear Prediction), a speech coding method for CDMA mobile communication systems, uses 25% of the total bits for LPC quantization, and an AMR_WB speech coder by Nokia uses 9.6 to 27.3% of the total bits for the LPC quantization in nine modes. So far, many kinds of efficient LPC quantization methods have been developed and actually utilized in speech compressors. Direct quantization of the coefficients of the LPC filter is problematic in that the filter is too sensitive to the quantization error of the coefficients to guarantee stability of the LPC filter after coefficient quantization. Accordingly, there is a need for converting the LPC to another parameter more suitable for quantization, such as a reflection coefficient or an LSF. In particular, the LSF value has a close relationship with the frequency characteristic of the speech signal so that most of the recent standard speech coders employ the LSF quantization method.

For efficient quantization, use is made of a correlation between frames of the LSF coefficient. Namely, the LSF of the current frame is not directly quantized but is predicted from that of the previous frame to quantize the prediction error. The LSF value is closely related to the frequency characteristic of the speech signal and thus is predictable in terms of time to obtain a considerably large prediction gain.

There are two prediction methods, one using an autoregressive (AR) filter and the other using a moving average (MA) filter. The AR filter is superior in prediction performance but causes coefficient-transfer error propagation from one frame to another at a receiver. The MA filter is inferior in prediction performance to the AR filter but it is advantageous in that the effect of the transfer error is restrained over time. Accordingly, a prediction method with an MA filter is used in speech compressors such as AMR, CS-ACELP or EVRC that are utilized in environments in which many transfer errors occur, such as in radio communications.

The present invention solves the prediction error problem by use of both an AR predictor and a safety net. A quantization method using a correlation between neighboring LSF factors within a frame instead of LSF prediction between frames has also been developed. In particular, this method can promote the efficiency of quantization since the LSF values satisfy the order property.

It is impossible to quantize all vectors at the same time because of an extremely large vector table and a long retrieving time. To overcome this problem, a so-called split vector quantization (SVQ) method is suggested wherein the total vector is split into several subvectors, which are independently quantized. For example, the size of the vector table is $10\times10^{20}$ in $10^{th}$-order vector quantization using 20 bits, but it is no more than $5\times10^{20}\times2$ in split vector quantization where the vector is split into two $5^{th}$-order subvectors to which 10 bits are independently allocated. Splitting the vector into more subvectors reduces the size of the vector table to save memory space, and hence the retrieving time, but it does not make the most of the correlation between vector values so it deteriorates performance.

With the vector split into ten $1^{st}$-order vectors, for example, the $10^{th}$-order vector quantization becomes scalar quantization. Assuming that split vector quantization is used to qauntize the LSF directly without LSF prediction between 20 msec frames, 24 bits are required to attain the quantization performance. The split vector quantization method, in which the respective subvectors are independently quantized, causes a problem in that it cannot make the most of the correlation between the subvectors, hence it fails to optimize the total vector. Examples of other quantization methods recently developed include multi-stage vector quantization, a selective vector quantization method using two tables, and a linked split vector quantization method wherein a table to be used is selected with reference to the boundary values of the individual subvectors.

Although a general vector quantizer is required to store code books, the split vector quantizer has only to store the index of code books and enable ready calculation of the output vector without comparing the output vector with all other output codes possible in coding.

In general, the lattice is a set of $n^{th}$-order vectors defined as Equation 1:

$$\Lambda=\{x|x=c_1a_1+c_2a_2+\ldots+c_na_n\} \quad \text{[Equation 1]}$$

The split vector quantizer is largely classified into a uniform split vector quantizer and a pseudo-uniform split vector quantizer, and includes, depending on the type of code book, a spherical split vector quantizer or a pyramid split vector quantizer. The spherical split vector quantizer is suitable for a source having a Gaussian distribution, the pyramid split vector quantizer being suitable for a source having a Laplacian distribution.

SUMMARY OF THE INVENTION

It is an object of the present invention to provide an LSF quantizer for a wideband speech coder that reduces the size of memory and the computational complexity for retrieval of code books required in LPC quantization with an increase in the LPC order, and that decreases the number of outliers, with enhanced performance.

In one aspect of the present invention, an LSF (Line Spectral Frequency) quantizer for a wideband speech coder comprises: a subtracter for receiving an input LSF coefficient vector and removing a DC component from it; a memory-based vector quantizer and a memoryless vector quantizer for respectively receiving the DC component removed LSF coefficient vector and independently quantizing the same; a switch for receiving quantized vectors respectively quantized by the memory-based vector quantizer and the memoryless vector quantizer, selecting a quantized vector that has less quantized error that is a difference between the received quantized vector and the input LSF coefficent vector from among the received quantized vectors, and outputting the same; and an adder for adding the quantized vector selected by the switch to the DC component of the LSF coefficient vector.

BRIEF DESCRIPTION OF THE DRAWINGS

The accompanying drawing, which is incorporated in and constitutes a part of the specification, illustrates an embodiment of the invention, and, together with the description, serves to explain the principles of the invention.

DETAILED DESCRIPTION OF THE PREFERRED EMBODIMENTS

Figure 1:
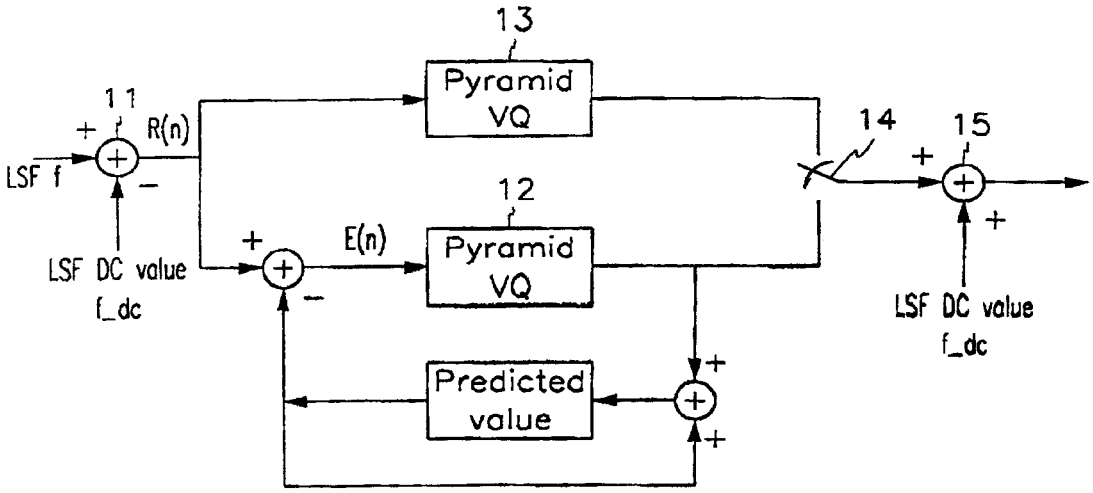
FIG. 1 is a schematic of an LSF quantizer for a wideband speech coder in accordance with an embodiment of the present invention.

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawing and description are to be regarded as illustrative in nature, and not restrictive.

Hereinafter, a detailed description will be given to an LSF quantizer for a wideband speech coder in accordance with an embodiment of the present invention with reference to the accompanying drawing.

For LSF quantization, an AMR_WB speech coder uses an S-MSVQ (Split-Multi Stage VQ) structure in which the DC component is removed, and a $16^{th}$-order prediction error vector, i.e., a difference value between a $16^{th}$-order LSF coefficient and a vector predicted by a primary MA predictor, is split into one $9^{th}$-order subvector and one $7^{th}$-order subvector for vector quantization, the $9^{th}$-order subvector being further split into three $3^{rd}$-order subvectors, and the $7^{th}$-order subvector being further split into one $3^{rd}$-order subvector and one $4^{th}$-order subvector. Such an S-MSVQ structure is to reduce the size of the memory and the code-book retrieving time required for 46-bit LSF coefficient quantization, and actually needs a relatively smaller memory and less computational complexity for retrieval of code books compared to the full VQ structure. But the S-MSVQ structure still requires a large memory ($2^8+2^8+2^6+2^7+2^7+2^5+2^5$) and a great deal of computational complexity because of complexity in retrieving code books.

For LSF quantization, the DC component is removed from the LSF value, and the LSF coefficient vector removed of the DC component is input to both a memory-based split quantizer (i.e., predictive PVQ) and a memoryless split quantizer (i.e., PVQ). The memory-based split quantizer (predictive PVQ), which is designed for fine quantization, pyramid-vector-quantizes an error vector that is a difference between a vector predicted by the primary AR predictor and an input vector. The memoryless split quantizer, which is designed to reduce the number of outliers, directly pyramid-vector-quantizes the input vector. A candidate vector that minimizes an Euclidean distance from the original input vector from among two candidate vectors qunatized by the two qunatizers is selected to be a final quantized vector . Accordingly, the quantizer of the present invention has a strong point in that it provides the characteristics of both the memory-based split quantizer for fine quantization and the memoryless split quantizer for reducing the number of outliers.

The PVQ performance becomes favorable when the order of the input vector is high enough. That is, when the order of the input vector is more than about 20, the value $\|\tilde{c}(n)\|$ approximates a constant irrespective of the value of n. Otherwise, when the order of the input vector is below 20, the value $\|\tilde{c}(n)\|$ does not approximate a constant because of the large distribution of $\|\tilde{c}(n)\|$ This causes error propagation in quantization using a single pyramid. To solve this problem, there is suggested a product code PVQ (PCPVQ) that normalizes an input vector, quantizes it with a single pyramid and indexes the quantized pyramid using a normalized factor, $\hat{\gamma}Q=(\|\tilde{c}(n)\|)$. Here, $Q(\cdot)$ represents a scalar quantizer. When $\hat{c}(n)=PVQ(\hat{v}(n))$ is the output vector of PVQ and $\hat{\gamma}=Q(\|\tilde{c}(n)\|)$ is the output value of the scalar quantizer, the output vector of the product code PVQ, $\hat{c}_{PCPVQ}(n)$ is given by Equation 2:

$$\hat{c}_{PCPVQ}(n)=\hat{\gamma}\leftrightarrow\hat{c}(n) \quad \text{[Equation 2]}$$

This has an effect of using as many pyramids as quantization levels of the scalar quantizer. When the bit rate per average vector order of PVQ is $R_p$ and the bit rate assigned to the scalar quantizer is $R_\gamma$, the total bit rate R satisfies Equation 3:

$$R_pL+R_\gamma=RL \quad \text{[Equation 3]}$$

FIG. 1 is a block diagram of a wideband LSF quantizer using a memory-based predictive pyramid VQ and a memoryless pyramid VQ in accordance with an embodiment of the present invention.

The wideband LSF quantizer comprises: a subtracter 11 for receiving an input LSF coefficient vector and removing the DC component ; a memory-based PVQ 12 and a memoryless PVQ 13 for receiving the DC component-removed LSF coefficient vector R(n) and quantizing the same; a switch 14 for selecting the one of the vectors quantized by the memory-based PVQ 12 and the memoryless PVQ 13 that has the shorter Euclidean distance from the input LSF coefficient vector, and outputting the same; and an adder 15 for adding the vector selected by the switch 14 to the DC component of the LSF coefficient vector.

As described previously, the LSF coefficient quantizer for an AMR_WB speech coder using both a split VQ and a multi-stage VQ requires a relatively smaller memory and less computational complexity for retrieval of code books compared to the full VQ, but it still needs a large memory and a great deal of computational complexity. Additionally, the memory VQ structure causes error propagation. To solve this problem, the present invention uses a split vector quantizer that reduces the number of outliers and provides a simple coding procedure with a small memory. In particular, the present invention suggests a PVQ LSF coefficient quantizer using a pyramid split vector quantizer suitable for quantization of Laplacian signals, considering that the distribution of LSF coefficients has a characteristic of Laplacian signals.

An operation of the quantizer shown in FIG. 1 is as follows. Upon receiving an LSF coefficient vector, the subtracter 11 removes the DC component from the LSF coefficient vector. The DC component-removed LSF coefficient vector is fed into both the memory-based PVQ 12 and the memoryless PVQ 13 to be independently quantized. The memory-base PVQ, i.e., the predictive pyramid VQ, predicts the input vector using a primary AR predictor, and uses the pyramid VQ (PVQ) to quantize a prediction error vector which is a difference between the predicted vector and the input vector. The memoryless PVQ, i.e., pyramid VQ (PVQ), quantizes the input vector in the full vector format using a pyramid VQ designed for focusing on the outliers. The quantized error, that is, a difference between each of the quantized vectors and the input vector, is determined in terms of Euclidean distance, so that a candidate vector having a less quantized error is selected as the quantized vector. The quantized values obtained by the two quantizers in a quantization program produce two Euclidean distances as error values between the value before quantization and the quantized value. The quantizer of the present invention selects the one of the two quantized values that has the shorter Euclidean distance.

As described above, the present invention employs a split vector quantizer of a novel structure as an LSF coefficient quantizer for an AMR_WB speech coder in order to reduce the size of memory and computational complexity for retrieval of code books, and to improve the bit rate and the spectral distortion (SD).

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

According to the present invention, as described above, the use of a split vector quantizer and a safety net in the LSF coefficient quantizer greatly reduces the size of the memory and the computational complexity for retrieval of code books without a deterioration of the SD performance. An experiment reveals that the total number of bits used to attain an SD performance of 1 dB using the above quantizer is no more than 39 bits, which is less by 7 bits than the 46 bits required by an AMR-WB speech coder.

What is claimed is:

1. An LSF (Line Spectral Frequency) quantizer for a wideband speech coder, comprising:

a subtracter for receiving an input LSF coefficient vector and removing a DC component from it;

a memory-based vector quantizer and a memoryless vector quantizer for respectively receiving the DC component removed LSF coefficient vector and independently quantizing the same;

a switch for receiving quantized vectors respectively quantized by the memory-based vector quantizer and the memoryless vector quantizer, selecting a quantized vector that has less quantized error that is a difference between the received quantized vector and the input LSF coefficent vector from among the received quantized vectors, and outputting the same; and an adder for adding the quantized vector selected by the switch to the DC component of the LSF coefficient vector.

2. The LSF quantizer for a wideband speech coder as claimed in claim 1, wherein the memory-based vector quantizer and the memoryless vector quantizer are respectively a memory-based split vector quantizer and a memoryless split vector quantizer.

3. The LSF quantizer for a wideband speech coder as claimed in claim 2, wherein the memory-based vector quantizer predicts the input LSF coefficient vector using a primary auto-regressive (AR) predictor, and pyramid-vector-quantizes a prediction error vector that is a difference between the predicted vector and the input LSF coefficient vector.

4. The LSF quantizer for a wideband speech coder as claimed in claim 2, wherein the memoryless split vector quantizer pyramid-vector-quantizes the input LSF coefficient vector in a full vector format.

5. The LSF quantizer for a wideband speech coder as claimed in claim 2, wherein the switch determines quantized errors using an Euclidean distance.

6. An LSF (Line Spectral Frequency) quantization method for a wideband speech coder, comprising:

(a) removing a DC component from an LSF coefficient vector;

(b) predicting the DC-component-removed LSF coefficient vector using a primary auto-regressive (AR) predictor, and pyramid-vector-quantizing a prediction error vector that is a difference between the predicted vector and the input LSF coefficient vector;

(c) pyramid-vector-quantizing the DC-component-removed LSF coefficient vector in a full vector format;

(d) receiving the quantized vectors respectively quantized in (b) and (c), selecting a quantized vector that has less quantized error that is a difference between the received quantized vector and the input LSF coefficent vector from among the received quantized vectors, and outputting the same; and (e) adding the quantized vector selected in (d) to the DC component of the LSF coefficient vector.

7. The LSF quantization method for a wideband speech coder as claimed in claim 6, wherein in (d), the quantized error is determined using a Euclidean distance.

* * * * *